US007490825B2

(12) United States Patent
Bantlin et al.

(10) Patent No.: US 7,490,825 B2
(45) Date of Patent: Feb. 17, 2009

(54) METHOD FOR SYNCHRONIZING THE MAIN PILE AND THE AUXILIARY PILE

(75) Inventors: Michael Bantlin, Wiesloch (DE); Wolfgang Dolz, Heidelberg (DE); Rolf Spilger, Viernheim (DE); Christian Thomas, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 845 days.

(21) Appl. No.: 10/766,275

(22) Filed: Jan. 28, 2004

(65) Prior Publication Data

US 2004/0186617 A1 Sep. 23, 2004

(30) Foreign Application Priority Data

Feb. 3, 2003 (DE) ..... 103 04 164

(51) Int. Cl.
*B65H 3/44* (2006.01)

(52) U.S. Cl. ..... 271/9.02

(58) Field of Classification Search ..... 271/145, 271/147, 9.02, 9.03, 9.07, 9.08, 9.05, 9.12, 271/152; 414/795.8, 796.7; 101/484, 485, 101/232

See application file for complete search history.

(56) References Cited

U.S. PATENT DOCUMENTS 4,021,710 A * 5/1977 Fichte et al. ..... 318/39
5,556,252 A * 9/1996 Kuster ..... 414/796.7
5,626,335 A * 5/1997 Radwanski et al. ..... 271/159
6,142,463 A * 11/2000 Leichnitz et al. ..... 271/159
6,286,826 B1 * 9/2001 Hummel et al. ..... 271/159
6,290,225 B1 * 9/2001 Linder et al. ..... 271/155
6,361,039 B1 * 3/2002 in 't Zandt et al. ..... 271/159

FOREIGN PATENT DOCUMENTS

DE 19516582 11/1996
DE 19735895 9/1998

* cited by examiner

*Primary Examiner*—Patrick H Mackey
*Assistant Examiner*—Thomas A Morrison
(74) *Attorney, Agent, or Firm*—Davidson, Davidson & Kappel, LLC

(57) ABSTRACT

A method for synchronizing the motion sequences of at least one main pile and at least one auxiliary pile in a feeder or delivery device of a printing material processing machine (20) having the following features: a drive (7) for moving the main pile (4) and a main pile controller (12) associated with the drive (7), an additional drive (11) for moving the auxiliary pile (9) and an auxiliary pile controller (13) associated with the additional drive (11). The auxiliary pile controller (13) receives from main pile controller (12) or from a further, higher-level machine controller (14) a start signal to move the auxiliary pile (9), the start signal simultaneously initiating a movement of the main pile (4). A related device is provided.

10 Claims, 1 Drawing Sheet

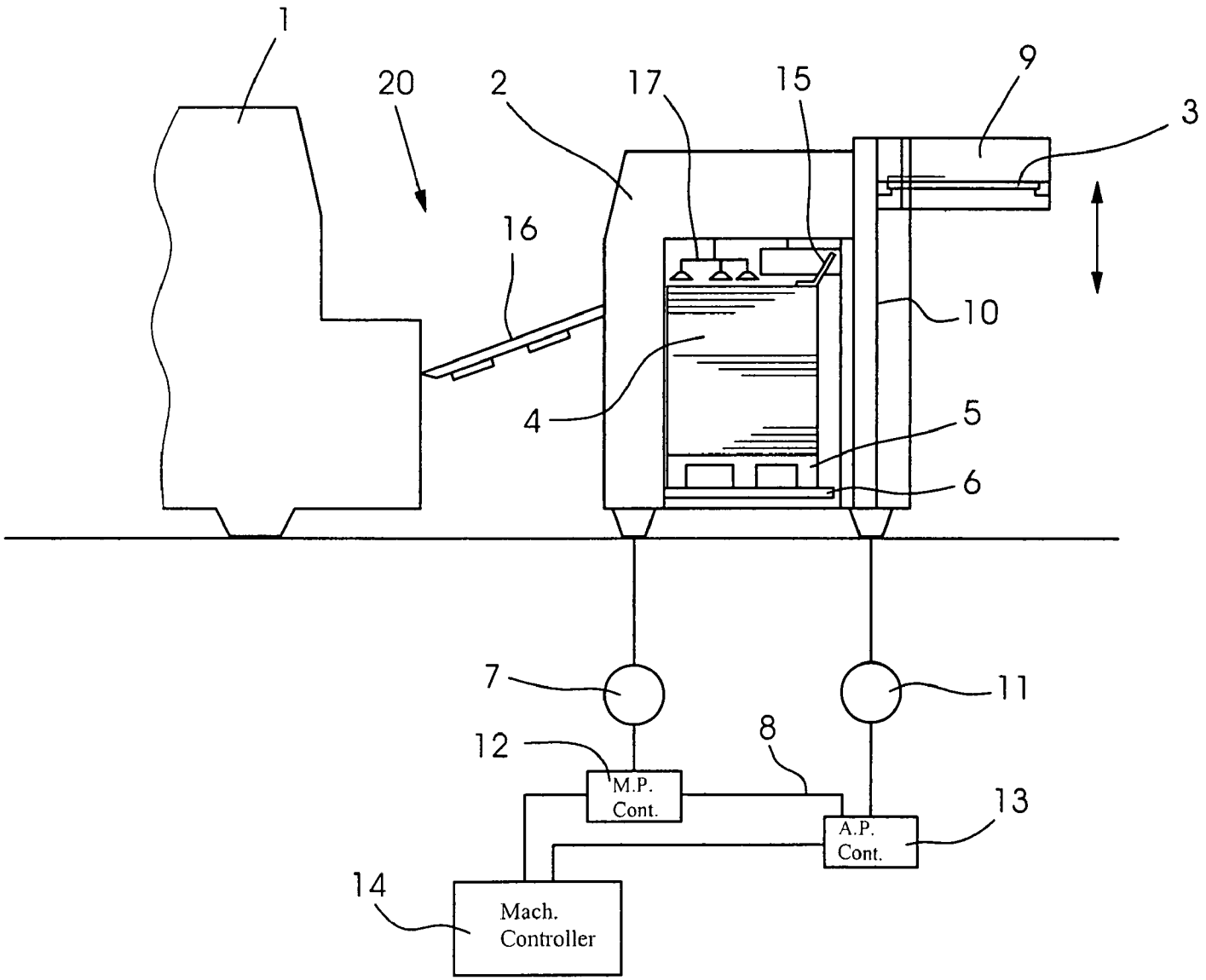
3
9
10
5
6
11
13
15
17
2
16
4
7
12
8
A.P. Cont.
M.P. Cont.
Mach. Controller
14
20
1

METHOD FOR SYNCHRONIZING THE MAIN PILE AND THE AUXILIARY PILE

This claims priority to German Patent Application No. 103 04 164.8, filed Feb. 3, 2003 and hereby incorporated by reference herein.

BACKGROUND INFORMATION

The present invention relates to a method for synchronizing the motion sequences of at least one main pile and at least one auxiliary pile in a feeder or delivery device of a printing material processing machine having a drive for moving the main pile and a main pile controller associated with the drive, as well as an additional drive for moving the auxiliary pile including an auxiliary pile controller associated with the additional drive.

In sheet-fed rotary printing presses, the printing materials are fed from a feeder pile, which has to be regularly replenished when depleted. To this end, the feeder is essentially composed of a lifting device carrying a pallet with sheet stock. In the known feeders, a suction device removes sheet after sheet from this pile of sheet stock. In order that the sheet located on top of the pile is always at the same level, it is necessary to lift the pallet along with the sheet stock in the direction of the suction device, since the pile of sheet stock shrinks further and further due to the removal of sheets at the top. To prevent stoppage of the printing press when the pallet is depleted, many sheet-fed printing presses now have so-called "non-stop feeders", which make it possible to load a new pile of sheet stock before the old pile is completely depleted. This means that the new pile must already be loaded while sheets are still removed from the rest of the old pile. To this end, the non-stop feeder has a pile-changing device, such as a movable rake, which is slid under the depleting pile. In this manner, the pile is lifted from its pallet so that the pallet can be lowered by the lifting device of the main pile, removed, and a new pile is placed in the feeder along with the pallet. In the next step, the new pile must now be merged with the small remaining pile, that is, the main pile approaches the remaining pile until it touches the remaining pile. After that, the rake must be removed from below the remaining pile, which takes a certain time.

During this time, however, the new main pile and the remaining pile that is left over must carry out the same sequences of movements to prevent the main and auxiliary piles from diverging apart. This requires precise control of the drive motors of the main pile and auxiliary pile devices.

German Patent DE 197 35 895 C1, related to U.S. Pat. No. 6,142,463 which is hereby incorporated by reference herein, describes several ways to move the auxiliary and main piles synchronously. One way is to control the drive of the auxiliary pile device so that it tracks the drive of the main pile device; the movement of the main pile being monitored by sensors, thus making it possible to generate appropriate control commands to control the auxiliary pile. Another possibility described in German Patent DE 197 35 895 C1 is to control the drives of the main and auxiliary drives with on-times of equal duration, the intention of which is to produce lifting movements of equal length of the main and auxiliary piles. These methods have the disadvantage that the drives do not move synchronously in time, but only travel the same path. This means that one of the piles begins to move later than the other one. However, this results either in gaps between the main and auxiliary piles, or in slight collisions between the main and auxiliary piles. Moreover, on-times of equal duration will produce calculable travel paths only in the case of constant external conditions. As soon as a parameter, such as the pile weight, changes, the travel path changes too, thus making it completely impossible for the main and auxiliary piles to move synchronously.

BRIEF SUMMARY OF THE INVENTION

It is an object of the present invention to avoid the mentioned disadvantages of the prior art.

The present invention provides a method for synchronizing the motion sequences of at least one main pile (4) and at least one auxiliary pile (9) in a feeder or delivery device (2) of a printing material processing machine (20) having the following features:

- a drive (7) for moving the main pile (4) and a main pile controller (12) associated with the drive (7),
- an additional drive (11) for moving the auxiliary pile (9) and an auxiliary pile controller (13) associated with the additional drive (11), wherein the auxiliary pile controller (13) receives from the main pile controller (12) or from a further, higher-level machine controller (14) a start signal to move the auxiliary pile (9), the start signal simultaneously initiating a movement of the main pile (4).

To be able to carry out the method according to the present invention, the main and auxiliary piles each have separate drive devices. The drives of the main and auxiliary drives are controlled by closed-loop and open-loop control devices so as to ensure that the movements of the main and auxiliary piles start synchronously. To this end, each drive can be assigned a separate control device; i.e., the drive of the main pile has a main pile controller, and the drive of the auxiliary pile has an auxiliary pile controller. These control devices are, of course, in contact with a higher-level machine controller of the associated printing press or folding machine. However, it is also possible that the main and auxiliary pile controllers are no physically separate devices, but are executed together on one computer, which assumes the functions of the main and auxiliary pile controllers. Advantageously, both the main pile controller and the auxiliary pile controller simultaneously receive signals for moving the main and auxiliary piles. In this context, the start signal can be generated by the main pile controller or the higher-level machine control. It is also crucial that the main and auxiliary piles begin to move at the same time in response to the simultaneously transmitted start signal, i.e., that the control devices have equal dead times or response times.

In a first embodiment of the present invention, provision is advantageously made that the main pile and the auxiliary pile travel the same distance within the same time using controllers in the main pile controller and the auxiliary pile controller. To prevent the main and auxiliary piles from moving apart, the controllers of the main and auxiliary pile controllers are designed in such a manner that the main and auxiliary piles travel the same distance in the same time upon receipt of the simultaneously transmitted start signal. In this manner, the main and auxiliary piles not only begin to move at the same time, but always move in parallel.

Advantageously, provision is also made to store at least one of the last-reached positions of the auxiliary and/or main piles in the main pile controller and/or in the auxiliary pile controller and/or in the further, higher-level machine control. This specific embodiment allows the paths traveled so far to be analyzed so as to allow detection of possible deviations in the sequence of movements. In this manner, it is also possible to carry out a setpoint/actual value comparison between the actual paths traveled and the desired travel paths.

In another embodiment of the present invention, provision is made for the stored position to be taken into account in the calculation of future travel paths. After performing a setpoint/actual value comparison of the travel path, changes with respect to the travel paths can be included in the calculation of future travel. If during the setpoint/actual value comparison, it is found, for example, that the travel path of the auxiliary pile is always too short, then the travel path is correspondingly increased in future movements. In the opposite case, the travel path will, of course, be reduced accordingly. This is important, in particular, in the case of longer travel paths, since here the deviations add up, ultimately leading to a greater difference between the actual and expected travel paths.

In a further embodiment of the present invention, the travel paths of the main pile and/or auxiliary pile are transmitted as setpoint values to the main pile controller and/or the auxiliary pile controller. Since the main and auxiliary piles are mostly moved in steps, i.e., after the simultaneous start signal, the main and auxiliary piles move by a certain step size, it is useful to compare the setpoint values and the actual values of the travel paths after each movement of the main and auxiliary piles. To this end, the actual values of the travel paths of the main and auxiliary piles must be transmitted to one of the control devices so that they can be compared to the setpoint values there.

Furthermore, provision can be made for the start signal to be transmitted via a communication device between the auxiliary pile controller and the main pile controller. Conventional feeders mostly have physically separate main and auxiliary pile controllers; i.e., there are separate control electronics for each of the main and auxiliary piles. In this case, to avoid the need to make substantial structural changes to the design of such a feeder, it is convenient to connect the existing main and auxiliary pile controllers via a cable, for example, using a communication bus, thus providing the possibility of data exchange, in particular, for transmitting the start signal from the main pile controller to the auxiliary pile controller. This is a particularly cost-effective way to implement the method according to the present invention, because there is no need to make large changes to existing feeder systems.

In a further embodiment of the present invention, it is proposed to compensate for delays occurring during signal transmission via the communication device. If the signal propagation time over the communication device is not negligible, it can be accounted for by measuring the signal propagation time or further delays, and by taking the measured time into account in the control; i.e., the initiation of movement of the main pile is delayed by this measured time because it is known that the start signal only arrives at the auxiliary pile controller with a delay equal to this time. This offers that advantage that simultaneous starting of the main and auxiliary piles is ensured even if the communication device is relatively slow.

Furthermore, in yet another advantageous embodiment of the present invention, provision is made for the auxiliary pile controller and/or the main pile controller and/or the higher-level machine controller to measure disturbances and to take the disturbances into account in the control of the drives. Such disturbances can be changes in temperature, humidity, varying travel paths, increased friction, and further conditions of the feeder that change during operation. For example, the frictional resistances can change in the course of time due to wear or deteriorated lubrication of the lifting devices of the main and auxiliary piles, as a result of which the drive motors have to overcome correspondingly higher resistances. This, of course, affects the travel paths of the main and auxiliary piles, because now the load torques are changed. The same applies to different printing materials, which have different densities and thus different weights. In this case, it is useful to provide the changed conditions to the main and auxiliary pile controllers, for example, using weight sensors, to be able to take into account their effects on the travel paths of the main and auxiliary piles.

BRIEF DESCRIPTION OF THE DRAWINGS

The present invention is now described and illustrated in greater detail with reference to a drawing, in which.

FIG. 1 shows a non-stop feeder for a sheet-fed printing press with a main and auxiliary pile control system according to the present invention.

DETAILED DESCRIPTION

The exemplary embodiment according to FIG. 1 shows the feeder region of a printing press 20. In addition to feeder 2, the first printing unit 1 of printing press 20 can be seen, which is connected to feeder 2 via a suction-tape feed table 16 for transporting sheet stock. Via this suction-tape feed table 16, the sheet stock is fed to first printing unit 1 of printing press 20. In FIG. 1, feeder 2 is shown in a state where a new paper pile 4 has just been inserted. Paper pile 4 contains the sheet stock, which is removed sheet after sheet from paper pile 4 by a suction device 17 shown in FIG. 1, and fed to first printing unit 1 of printing press 20 via suction-tape feed table 16. Paper pile 4 is located on a pallet 5, which, in turn, is placed on a main pile support plate 6. Paper piles 4 are delivered by the paper supplier on the pallets 5 mentioned, because they can thus be easily loaded, for example, using a pallet mover or forklift truck. Using such a loading device, paper pile 4 is placed on main pile support plate 6 along with pallet 5, and from then on can be moved vertically. To this end, main pile support plate 6 is supported in the frame of feeder 2 in such a manner that it can be moved vertically, the lifting movement being accomplished by a main pile motor 7 and an associated gear device. Main pile motor 7 is advantageously a servomotor, just as the auxiliary pile motor 11 mentioned later. On the right side, feeder 2 has an auxiliary pile frame 10, which supports an auxiliary pile support device 3 in such a manner that it can be moved vertically. In FIG. 1, auxiliary pile support device 3 is shown in a state where it has not moved into the region of main pile 4; i.e., support device 3 is in the rest position.

Using a pile-top sensor 15 at feeder 2, it is ensured that the top edge of paper pile 4 in feeder 2 is always at the same level. This is important because it is only in this way that the topmost sheet of the paper pile 4 can be optimally transported by suction device 17 in the direction of suction-tape feed table 16. To allow the pile top to always have the same distance from pile-top sensor 15, main pile support plate 6, and thus paper pile 4, are constantly moved upward by main pile motor 7 according to the sheet removal rate. The sheet removal rate, in turn, is dependent on the printing speed of printing press 20.

When paper pile 4 approaches depletion, auxiliary pile support device 3, which usually has the form of a rake, is inserted between pallet 5 and the rest of paper pile 4, so that the rest of paper pile 4 now constitutes an auxiliary feeder pile 9 above support device 3. In order to allow the rake to move in below the paper pile, pallet 5 has grooves, on which the paper rests, in the insertion direction of rake-like auxiliary pile support device 3 so that rake-like auxiliary pile support device 3 can be inserted below the remaining paper pile 4 in these grooves. These pallets are usually made of plastic and are also referred to as "non-stop pallets".

After auxiliary pile device 3 has moved in, the empty pallet 5 can now be lowered on main pile support plate 6 and be removed. Then, a new paper pile 4 is placed on main pile support plate 6 along with the pallet to replace the empty pallet 5, and lifted by main pile motor 7 until the new paper pile 4 reaches auxiliary pile support device 3 of auxiliary feeder pile 9. In this situation, auxiliary pile support device 3 is laterally withdrawn from below the auxiliary feeder pile 9 so that auxiliary feeder pile 9 and main pile 4 are merged again. During this merging process, auxiliary feeder pile 9 and main pile 4 must be moved in parallel to ensure continued sheet removed by suction device 17.

This parallel movement of auxiliary feeder pile 9 and main pile 4 works only if main pile motor 7 and auxiliary pile motor 11 are controlled in a coordinated manner. According to the exemplary embodiment in FIG. 1, main pile motor 7 has a main pile controller 12, and auxiliary pile motor 11 has a separate auxiliary pile controller 13. Main pile controller 12 is used to move main pile support plate 6, and the paper pile 4 resting thereon, in as precise and defined a manner as possible. The same applies to auxiliary pile controller 13 and the associated auxiliary pile motor 11, which is capable of moving auxiliary feeder pile 9 on auxiliary pile support device 3. Both main pile controller 12 and auxiliary pile controller 13 are in communication with a higher-level machine controller 14 of printing press 20, because they must be provided, for example, with machine data, such as the current printing speed. As already explained, the rate of the sheet removal by suction device 17 is dependent on the printing speed of printing press 20, because at a lower printing speed, fewer sheets are removed from paper pile 4, while at a high printing speed, more sheets have to be removed from paper pile 4 during identical time periods. The more sheets are removed from paper pile 4 in the same time, the faster must paper pile 4, and thus main pile support plate 6, be lifted in order to keep the top edge of the pile always in the same position for suction device 17. Because of this, pile-top sensor 15 is connected to main pile controller 12 or to machine controller 14 to provide the signals that are required for control.

A communication device 8 between auxiliary pile controller 13 and main pile controller 12 allows main pile support plate 6 and auxiliary pile support device 3 to move synchronously during the merging process of auxiliary feeder pile 9 and main pile 4. In the exemplary embodiment according to FIG. 1, main pile controller 12 is designed as a so-called "master", while auxiliary pile controller 13 is designed as a so-called "slave". This means nothing else than that auxiliary pile controller 13 copies the movements of main pile controller 12 simultaneously. To ensure this synchronicity, a start signal is transmitted from main pile controller 12 to auxiliary pile controller 13 via communication device 8, the start signal at the same time being the start signal at main pile controller 12. This start signal initiates the movement of main pile motor 7 and auxiliary pile motor 11 simultaneously. In this context, communication device 8 is so fast that the start signal from main pile controller 12 is also present at auxiliary pile controller 13 nearly simultaneously. Therefore, communication device 8 is a correspondingly fast data bus. When using a relatively slow bus, i.e., transmission time>3 ms, the transmission time must be taken into account accordingly so that the response of main pile motor 7 is delayed by the transmission time, in which case main and auxiliary pile motors 7, 11 also start simultaneously.

In this context, the magnitude of the travel path of main pile motor 7 and auxiliary pile motor 11 depends on the signals of pile-top sensor 15. Pile-top sensor 15 continuously reports the position of the top edge of paper pile 4 to main pile controller 12, which processes this position accordingly. If main pile controller 12 detects the top edge of paper pile 4 to be too low, then main pile controller 12 sends a signal to main pile motor 7 to move upward by a defined distance, then rechecks the signal of pile-top sensor 15 in order to move upward by the defined distance again if the distance from pile-top sensor 15 is still too large. The auxiliary feeder pile 9 is also moved over the same defined distance by auxiliary pile motor 11 as soon as auxiliary pile controller 13 has received the start signal from main pile controller 12 via communication device 8. In this manner, main pile support plate 6 and auxiliary pile support device 3 are simultaneously lifted by the same defined distance.

Changes in the external conditions or system-inherent changes may result in slight deviations from the defined distance during the upward movement. This is due, for example, to the fact that in the case of high air humidity, paper pile 4 attracts water, and therefore has a higher weight than in the dry state. This higher weight then requires a correspondingly higher torque of main pile motor 7 if the same defined distance is to be traveled in the same time. For this reason, both auxiliary pile controller 13 and main pile controller 12 measure the traveled distance upon completion of the upward movement, and store possible deviations from this defined distance in the respective control. In this context, it is not important whether, in the end, the movement takes place continuously or discontinuously, as described. In the further upward movements, the deviations are then taken into account appropriately so that the system works in a self-learning manner.

Besides the different pile weight, further influences include, for example, the maintenance condition, because, for example, deteriorated lubrication of the moving parts of feeder 2 will result in increased resistance during the upward movement. The electromagnetic brakes also deteriorate in effectiveness over time so that their response times increase.

LIST OF REFERENCE NUMERALS

1 printing unit
2 feeder, device
3 auxiliary pile support device
4 main pile
5 pile pallet
6 main pile support plate
7 main pile motor
8 communication device
9 auxiliary pile or space above auxiliary pile support device
10 auxiliary pile frame
11 auxiliary pile motor
12 main pile controller
13 auxiliary pile controller
14 machine controller
15 pile-top sensor
16 suction-tape feed table
17 suction device
20 printing press

What is claimed is:

1. A method for synchronizing the motion sequences of at least one main pile and at least one auxiliary pile in a feeder or delivery device of a printing material processing machine, the method comprising:

moving the main pile using a drive and a main pile controller associated with the drive;

moving the auxiliary pile using an additional drive and an auxiliary pile controller associated with the additional drive; and receiving a start signal at the auxiliary pile controller to move the auxiliary pile, the start signal being received from the main pile controller or from a further, higher-level machine controller, the start signal simultaneously initiating a movement of the main pile.

2. The method as recited in claim 1 wherein the moving of the main pile and the moving of the auxiliary pile include moving the main pile and the auxiliary pile a same distance within a same time using the main pile controller and the auxiliary pile controller.

3. The method as recited in claim 1 further comprising storing at least one of a last-reached position of the auxiliary pile and a last-reached position of the main pile in at least one of the main pile controller, the auxiliary pile controller and the further, higher-level machine controller.

4. The method as recited in claim 3 further comprising moving at least one of the auxiliary and main piles as a function of the at least one of a last-reached position of the auxiliary pile and a last-reached position of the main pile.

5. The method as recited in claim 1 further comprising transmitting a travel path of the main pile or a travel path of the auxiliary pile as a setpoint value to the main pile controller or the auxiliary pile controller, respectively.

6. The method as recited in claim 1 further comprising transmitting the start signal via a communication device between the auxiliary pile controller and the main pile controller.

7. The method as recited in claim 6 further comprising compensating for delays occurring during signal transmission via the communication device.

8. The method as recited in claim 1 further comprising measuring disturbances and taking into account the disturbances in the control of the drive and additional drive.

9. A feeder or delivery device of a printing material processing machine having synchronized motion sequences of at least one main pile and at least one auxiliary pile comprising:

a drive for moving the main pile;

a main pile controller associated with the drive;

an additional drive for moving the auxiliary pile; and an auxiliary pile controller associated with the additional drive, the auxiliary pile controller receiving a start signal to move the auxiliary pile, the start signal being received from the main pile controller or from a further, higher-level machine controller, the start signal simultaneously initiating a movement of the main pile.

10. The feeder or delivery device as recited in claim 9 wherein the device is part of a printing press or a folding machine.

* * * * *